US009957755B2

(12) United States Patent
Schurmann

(10) Patent No.: US 9,957,755 B2
(45) Date of Patent: May 1, 2018

(54) DIRECTIONAL DRILLING USING A ROTATING HOUSING AND A SELECTIVELY OFFSETABLE DRIVE SHAFT

(71) Applicant: Halliburton Energy Services, Inc., Houston, TX (US)

(72) Inventor: Jacob A. Schurmann, Spruce Grove (CA)

(73) Assignee: Halliburton Energy Services, Inc., Houston, TX (US)

( * ) Notice: Subject to any disclaimer, the term of this patent is extended or adjusted under 35 U.S.C. 154(b) by 446 days.

(21) Appl. No.: 14/650,204

(22) PCT Filed: Dec. 19, 2012

(86) PCT No.: PCT/US2012/070600
§ 371 (c)(1),
(2) Date: Jun. 5, 2015

(87) PCT Pub. No.: WO2014/098842
PCT Pub. Date: Jun. 26, 2014

(65) Prior Publication Data

US 2015/0308193 A1 Oct. 29, 2015

(51) Int. Cl.
*E21B 7/06* (2006.01)
*E21B 3/00* (2006.01)
*E21B 4/04* (2006.01)

(52) U.S. Cl.
CPC ..... *E21B 7/068* (2013.01); *E21B 3/00* (2013.01); *E21B 4/04* (2013.01); *E21B 7/062* (2013.01); *E21B 7/067* (2013.01)

(58) Field of Classification Search
CPC ..... E21B 7/068; E21B 7/067; E21B 7/062; E21B 7/28; E21B 7/04; E21B 4/04; E21B 3/00; E21B 44/00
See application file for complete search history.

(56) References Cited

U.S. PATENT DOCUMENTS 4,646,855 A * 3/1987 Dellinger ..... E21B 7/04 175/61
6,092,610 A * 7/2000 Kosmala ..... E21B 4/20 175/27

(Continued)

FOREIGN PATENT DOCUMENTS

CN 100379936 C 4/2008
WO 2005/028805 A1 3/2005

OTHER PUBLICATIONS

Office Action issued in related Chinese Application No. 201280077245.3, dated Jan. 4, 2016 (23 pages).

(Continued)

*Primary Examiner* — Robert E Fuller
*Assistant Examiner* — David Carroll
(74) *Attorney, Agent, or Firm* — Alan Bryson; Baker Botts L.L.P.

(57) ABSTRACT

Example systems described herein may include a housing 201 and an offsetable drive shaft 202 coupled to a drill bit 203 and at least partially disposed within the housing 201. The offset angle of the offsetable drive shaft 202 may determine an angle of the drill bit face. A motor 204 may be coupled to the housing 201 that, when activated, independently rotates the housing 201. By independently counter-rotating the housing 201 relative to a drill string during drilling operations, the angular orientation of the offsetable drive shaft 202 and drill bit 203 may remain geo-stationary with respect to the surrounding formation, without requiring that the housing 201 engage a borehole wall.

19 Claims, 3 Drawing Sheets

(56) References Cited

U.S. PATENT DOCUMENTS

| | | | | |
|---|---|---|---|---|
| 6,415,878 | B1 * | 7/2002 | Cargill | E21B 7/062 175/61 |
| 6,467,557 | B1 * | 10/2002 | Krueger | E21B 4/18 175/104 |
| 7,306,058 | B2 * | 12/2007 | Cargill | E21B 7/062 175/76 |
| 7,343,988 | B2 * | 3/2008 | Jamieson | E21B 7/062 175/263 |
| 7,987,927 | B2 * | 8/2011 | Downton | E21B 7/067 175/27 |
| 2002/0175003 | A1 * | 11/2002 | Pisoni | H03H 7/09 174/255 |
| 2004/0104051 | A1 * | 6/2004 | Moriarty | E21B 7/06 175/57 |
| 2013/0240268 | A1 * | 9/2013 | Crowley | E21B 7/068 175/61 |
| 2014/0048334 | A1 * | 2/2014 | Pabon | E21B 7/06 175/61 |
| 2014/0182941 | A1 * | 7/2014 | Oppelaar | E21B 7/067 175/61 |

OTHER PUBLICATIONS

International Search Report and Written Opinion issued in related PCT Application No. PCT/US2012/070600 dated Aug. 1, 2013, 11 pages.

* cited by examiner

DIRECTIONAL DRILLING USING A ROTATING HOUSING AND A SELECTIVELY OFFSETABLE DRIVE SHAFT

CROSS-REFERENCE TO RELATED APPLICATION

The present application is a U.S. National Stage Application of International Application No. PCT/US2012/070600 filed Dec. 19, 2012, which is incorporated herein by reference in its entirety for all purposes.

BACKGROUND

The present disclosure relates generally to well drilling operations and, more particularly, to directional drilling using a rotating housing and a selectively offsetable drive shaft.

As well drilling operations become more complex, and hydrocarbon reservoirs correspondingly become more difficult to reach, the need to precisely locate a drilling assembly—both vertically and horizontally—in a formation increases. Part of this operation requires steering the drilling assembly, either to avoid particular formations or to intersect formations of interest. Steering the drilling assembly includes changing the direction in which the drilling assembly/drill bit is pointed. Typically, this is accomplished using engagement mechanisms that contact the borehole wall to force the drilling assembly off-center within the wellbore or to maintain a portion of the drilling assembly in a stationary position. Unfortunately, these engagement mechanisms can be problematic, particularly when they must pass through important mechanisms, such as blowout preventers, that can be crucial for safety during drilling operations.

FIGURES

Some specific exemplary embodiments of the disclosure may be understood by referring, in part, to the following description and the accompanying drawings.

Figure 4:
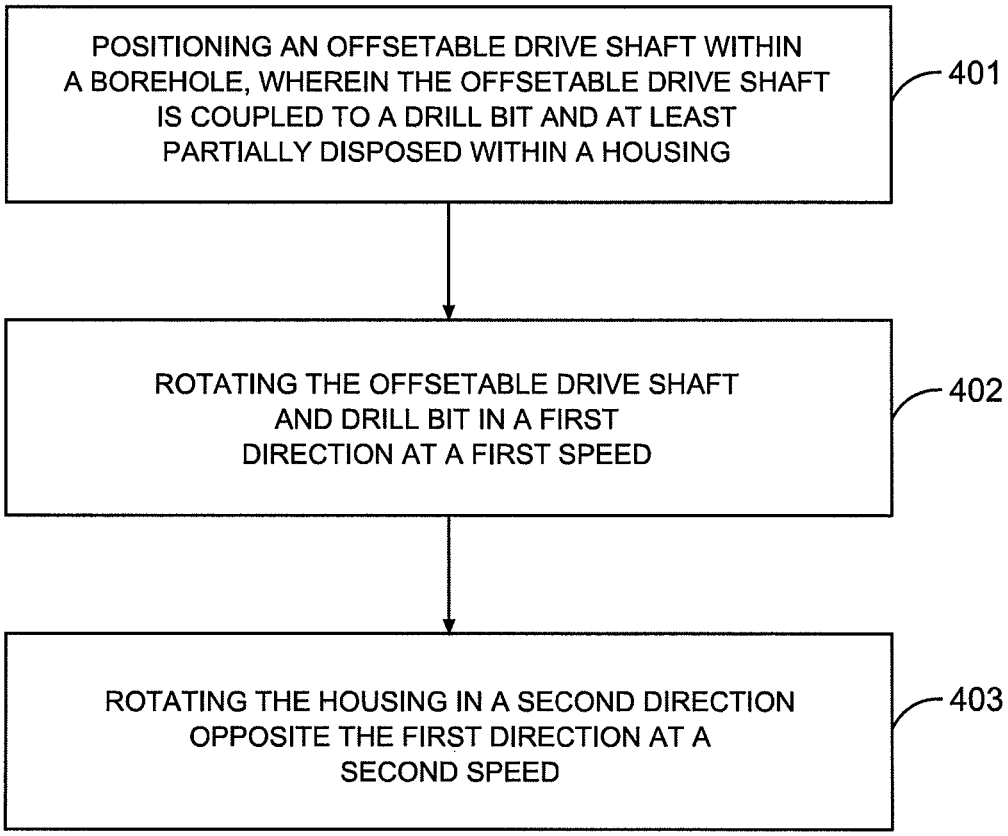

FIG. 4 is a flowchart illustrating an example drilling method, according to aspects of the present disclosure While embodiments of this disclosure have been depicted and described and are defined by reference to exemplary embodiments of the disclosure, such references do not imply a limitation on the disclosure, and no such limitation is to be inferred. The subject matter disclosed is capable of considerable modification, alteration, and equivalents in form and function, as will occur to those skilled in the pertinent art and having the benefit of this disclosure. The depicted and described embodiments of this disclosure are examples only, and not exhaustive of the scope of the disclosure.

DETAILED DESCRIPTION

The present disclosure relates generally to well drilling operations and, more particularly, to directional drilling using a rotating housing and a selectively offsetable drive shaft.

Illustrative embodiments of the present disclosure are described in detail herein. In the interest of clarity, not all features of an actual implementation may be described in this specification. It will of course be appreciated that in the development of any such actual embodiment, numerous implementation-specific decisions must be made to achieve the specific implementation goals, which will vary from one implementation to another. Moreover, it will be appreciated that such a development effort might be complex and time-consuming, but would nevertheless be a routine undertaking for those of ordinary skill in the art having the benefit of the present disclosure.

To facilitate a better understanding of the present disclosure, the following examples of certain embodiments are given. In no way should the following examples be read to limit, or define, the scope of the disclosure. Embodiments of the present disclosure may be applicable to horizontal, vertical, deviated, multilateral, u-tube connection, intersection, bypass (drill around a mid-depth stuck fish and back into the well below), or otherwise nonlinear wellbores in any type of subterranean formation. Embodiments may be applicable to injection wells, and production wells, including natural resource production wells such as hydrogen sulfide, hydrocarbons or geothermal wells; as well as borehole construction for river crossing tunneling and other such tunneling boreholes for near surface construction purposes or borehole u-tube pipelines used for the transportation of fluids such as hydrocarbons. Embodiments described below with respect to one implementation are not intended to be limiting.

According to aspects of the present disclosure, systems and methods for controlling the direction of a drilling assembly within a borehole are described herein. One example system comprises a housing and an offsetable drive shaft coupled to a drill bit and at least partially disposed within the housing. As described herein, a drive shaft may be offsetable if the longitudinal axis of the drive shaft is configured to be offset from a longitudinal axis of the steering assembly. An offset angle of the offsetable drive shaft may correspond to a drilling angle of the drilling assembly. The system may also include a motor coupled to the housing that, when activated, independently rotates the housing relative to a drill string. As will be described below, by independently counter-rotating the housing relative to a drill string during drilling operations, the angular position of the offsetable drive shaft and drill bit may remain geostationary, without requiring that the housing engage a borehole wall.

Figure 1:
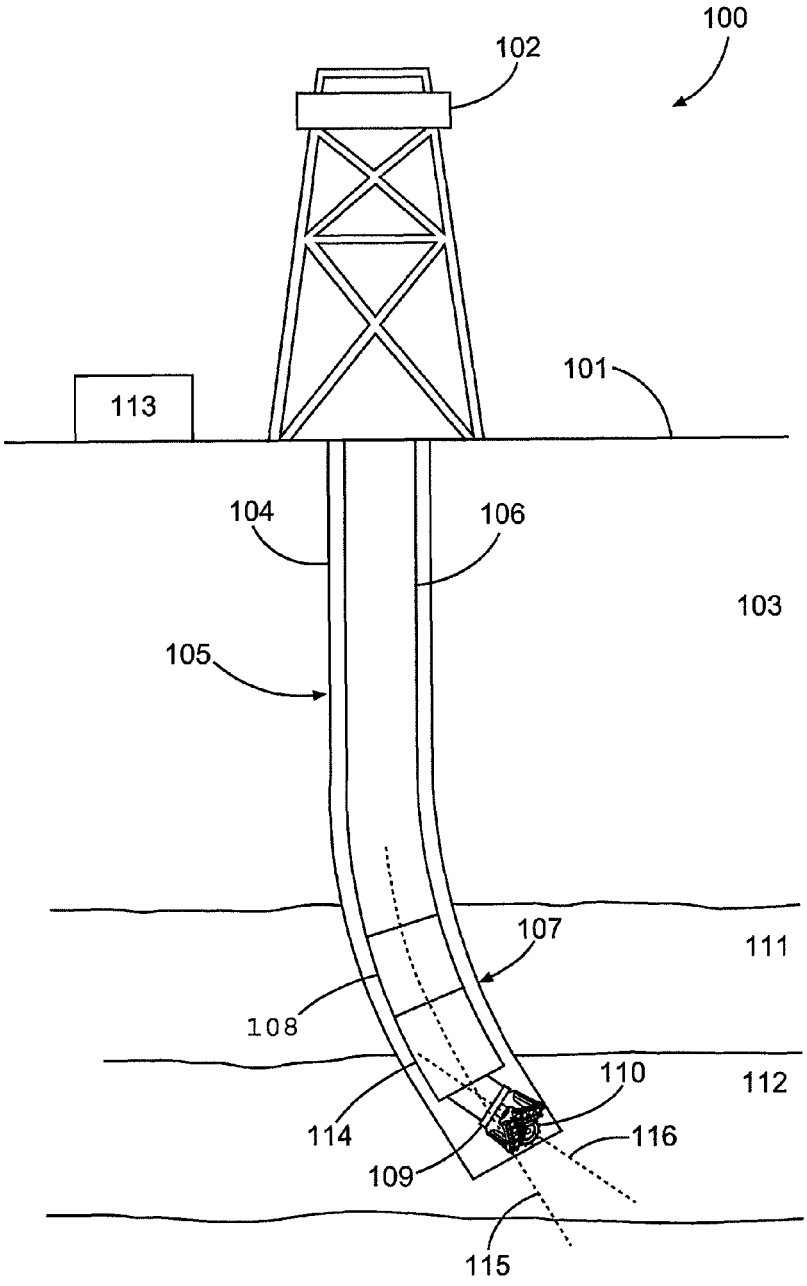
FIG. 1 is a diagram illustrating an example drilling system, according to aspects of the present disclosure.

FIG. 1 is a diagram illustrating an example drilling system 100, according to aspects of the present disclosure. The drilling system 100 includes a rig 102 mounted at the surface 101 and positioned above borehole 104 within a subterranean formation 103. In the embodiment shown, a drilling assembly 105 may be positioned within the borehole 104 and may be coupled to the rig 102. The drilling assembly 105 may comprise drill string 106 and bottom hole assembly (BHA) 107. The drill string 106 may comprise a plurality of segments threadedly connected. The BHA 107 may comprise a drill bit 109, a measurement-while-drilling (MWD) apparatus 108 and a steering assembly 114. The steering assembly 114 may control the direction in which the borehole 104 is being drilled. As will be appreciated by one of ordinary skill in the art in view of this disclosure, the borehole 104 will be drilled in the direction perpendicular to the tool face 110 of the drill bit 109, which corresponds to the longitudinal axis 116 of the drill bit. Accordingly, controlling the direction in which the borehole 104 is drilled may include controlling the angle of the longitudinal axis 116 of the drill bit 109 relative to the longitudinal axis 115 of the steering assembly 107, and controlling the angular orientation of the drill bit 109 with respect to the steering assembly 107.

According to aspects of the present disclosure that will be described below, the steering assembly 114 may include an offsetable drive shaft (not shown) that causes the longitudinal axis 116 of the drill bit 109 to deviate from the longitudinal axis 115 of the steering assembly 114. Likewise, the steering assembly 114 may include a counter-rotating housing (See, e.g., FIG. 2, element 201) that maintains an angular orientation of the drill bit 109 with respect to the steering assembly 114. The steering assembly 114 may receive control signals from a control unit 113 at the surface to determine the drilling direction. The control unit 113 may comprise an information handling system with a process and a memory device, and may communicate with the steering assembly 114 via a telemetry system. In certain embodiments, as will be described below, the control unit 113 may transmit control signals to the steering assembly to alter the longitudinal axis 115 of the drill bit 109 as well as to control counter-rotation of portions of the steering assembly 114 to maintain the tool face in a geo-stationary position. Moreover, other BHA 107 components, including the MWD apparatus 108, may communicate with and receive instructions from control unit 113.

In certain embodiments, the drill string 106 may be rotated to drill the borehole 104. The rotation of the drill string 106 may in turn rotate the BHA 107 and drill bit 109 with the same rotational direction and speed as the drill string 106. The rotation may cause the steering assembly 114 to rotate about its longitudinal axis 115, and the drill bit 109 to rotate around its longitudinal axis 116 and the longitudinal axis 115 of the steering assembly 114. The rotation of the drill bit 109 about its longitudinal axis 116 is desired to cause the drill bit 109 to cut into the formation, but the rotation of the drill bit 109 about the longitudinal axis 115 of the steering assembly 114 may be undesired in certain instances, as it changes the angular orientation of the drill bit 109 with respect to the steering assembly 114. For example, when the longitudinal axis 116 of the drill bit 109 is offset from the longitudinal axis 115 of the steering assembly 114, as it is in FIG. 1, the drill bit 109 may rotate about the longitudinal axis 115 of the steering assembly 114, preventing the drilling assembly from drilling at a particular angle and direction.

Figure 2:
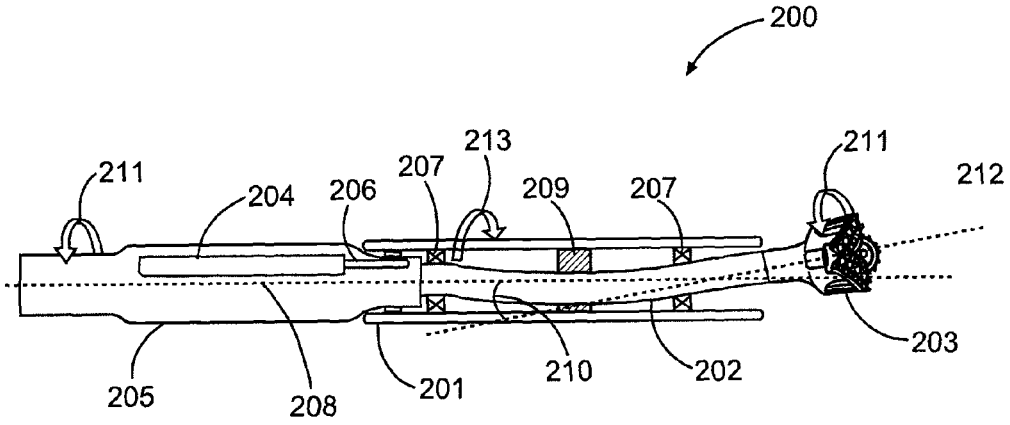
FIG. 2 is a diagram illustrating an example drilling system, according to aspects of the present disclosure.

FIG. 2 is a diagram illustrating an example steering assembly 200, according to aspects of the present disclosure, that may be used, in part, to maintain an angular orientation of a drill bit axis relative to the longitudinal axis of the steering assembly 200 drilling operations. As will be described below, the steering assembly 200 may include a housing 201 that can be counter-rotated to maintain a drill bit axis in a particular (geo-stationary) angular orientation with respect to the longitudinal axis of steering assembly 200. The steering assembly 200 may comprise an offsetable drive shaft 202 at least partially disposed within the housing 201 and coupled to a drill bit 203. A drive shaft may be offsetable if a longitudinal axis of the drive shaft is configured to be offset from a longitudinal axis of the steering assembly. Additionally, a drive shaft may be offsetable even though at a given time it may be aligned with the longitudinal axis of the steering assembly and therefore not offset. A motor 204 may be coupled to the housing 201 and, when activated, independently rotate the housing 201 relative to a tool collar 205. The tool collar 205 that may be coupled, directly or indirectly, to a drill string such that when the drill string rotates in a first direction with a first speed, the tool collar 205 rotates with the drill string, i.e. in the first direction with the first speed.

The offsetable drive shaft 202 may be directly or indirectly coupled to the tool collar 205. The housing 201 may be positioned proximate to an end of the tool collar 205 and be rotationally independent from the tool collar 205. In certain embodiments, the motor 204 may comprise an electric or hydraulic motor that may be at least partially disposed within the tool collar 205. Hydraulic motors may include mud motors that generate torque using the downward flow of a fluid, such as drilling mud, through the steering assembly. As can be seen in FIG. 2, the motor 204 may have an output shaft 206 that is coupled to and rotates the housing 201. In certain embodiments, the motor 204 may receive electric power from a power source, such as batteries or a downhole mud flow generator (not shown), positioned within the tool collar 205, or from a BHA element coupled to the tool collar 205. In certain other embodiments, the motor 204 may be driven directly by drilling mud. As will be described below, the motor 204 may be disposed within the tool collar 205 or outside of the tool collar, such as within housing 201.

As can be seen, the offsetable drive shaft 202 may be at least partially disposed within the housing 201. The offsetable drive shaft 202 may be secured within the housing 201 via focal points 207, which may comprise bearing/seals and may maintain an area of the offsetable drive shaft 202 centered within the housing 201 along the longitudinal axis 208 of the steering assembly 200. Between the focal points 207 may be an offset mechanism 209 that is disposed about the offsetable drive shaft 202 within the housing 201. The offset mechanism 209 may offset a portion of the offsetable drive shaft 202 from the longitudinal axis 208 of the steering assembly 200, which, in combination with the centered portions of the offsetable drive shaft 202 at focal points 207, may create an offset angle 210 in the offsetable drive shaft 202.

In certain embodiments, the offset mechanism 209 may be rotationally secured within the housing 201 and maintain the offset angle 210 of the offsetable drive shaft 202 and a pre-determined angle. In such embodiments, the offset mechanism 209 may comprise a disk, rotationally secured within the housing 201, with an eccentric hole offset a pre-determined distance from the longitudinal axis 208 of the steering assembly 200. The offset distance may be characterized as the radial distance the portion of the offsetable drive shaft 202 within the offset mechanism 209 is displaced from the longitudinal axis 208 of the steering assembly 200. The offset distance in combination with the distance of the offset mechanism 209 from at least one of the focal points 207 may define the offset angle 210. In other embodiments, the offset mechanism 209 may comprise a variable offset mechanism, allowing the offset angle 210 to be alterable within the housing 201. For example, in certain embodiments, the offset distance may be altered downhole, to vary the offset angle 210 of the offsetable drive shaft 202. The offset distance may be altered downhole using, for example, an additional downhole motor or actuators (not shown) that can alter the offset distance in response to a control signal from the surface. As will be appreciated by one of ordinary skill in the art in view of this disclosure, the offset angle 210 of the offsetable drive shaft 202 may cause an offset of the longitudinal axis 212 of the drill bit 203 relative to the longitudinal axis 208 of the steering assembly 208. Accordingly, by altering the offset angle 210, the longitudinal axis 212 of the drill bit 203 will change, as will the deviation angle of a borehole being drilled with the steering assembly 200.

During drilling operations, a drill string coupled, directly or indirectly, to the tool collar 205 may rotate in a first direction 211 at a first speed, thereby causing the offsetable drive shaft 202 and the drill bit 203 to also rotate in the first direction 211 at the first speed. Specifically, the drill bit 203 may rotate about its longitudinal axis 212 and the longitudinal axis 208 of the steering assembly 200. To maintain the angular orientation of the drill bit 203 axis relative to the longitudinal axis 208 of the steering assembly 200, the housing 201 may be rotated in a second direction 213 relative to the tool collar 205 opposite the first direction 211 at a second speed the same as the first speed. By counter-rotating the housing 201 relative to the tool collar 205, the housing 201, variable offset mechanism 209, and drill bit 203 may remain geo-stationary, i.e. substantially stationary with respect to the borehole, at an angular orientation relative to the longitudinal axis 208 of the steering assembly 200. Accordingly, the angular orientation of the longitudinal axis 212 of the drill bit 203 relative to the longitudinal axis 208 of the steering assembly 200 may be maintained, allowing the drilling assembly to drill in the direction of the longitudinal axis 212 of the drill bit 203, rather than the direction of the longitudinal axis 208 of the steering assembly.

Figure 3:
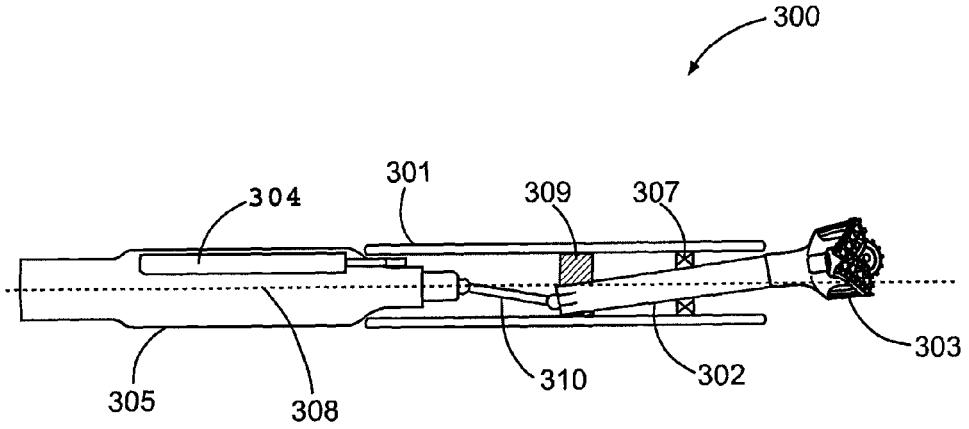
FIG. 3 is a diagram illustrating an example drilling system, according to aspects of the present disclosure.

FIG. 3 is a diagram illustrating another example steering assembly 300, according to aspects of the present disclosure. Like the steering assembly 200 of FIG. 2, the steering assembly 300 may comprise a rotationally independent housing 301 and an offsetable drive shaft 302 that is coupled to a drill bit 303 and at least partially disposed within the housing 301. Additionally, a motor 304 may be coupled to the housing 301, including through the use of an output shaft 306 from the motor 304. The steering assembly 300 may further comprise a tool collar 305 coupled to the offsetable drive shaft 302 and positioned proximate to an end of the housing 301. Unlike the steering assembly 200 where the offsetable drive shaft 202 is coupled directly to the tool collar 205, the offsetable drive shaft 302 may be coupled indirectly to the tool collar 305 through a CV shaft 310. As will be appreciated by one of ordinary skill in the art in view of this disclosure, the tool collar 305 may be coupled to the offsetable drive shaft 302 such that when the tool collar 305 rotates in a first direction with a first speed, the offsetable drive shaft 302 rotates in the first direction with the first speed.

As can also be seen, the steering assembly 300 may have an offset mechanism 309 and focal point 307 both disposed around the offsetable drive shaft 302 within the housing 301. As will be appreciated by one of ordinary skill in the art in view of this disclosure, the offset angle of the offsetable drive shaft 302 may still be characterized by the offset distance of the offsetable drive shaft 302 from the longitudinal axis 308 of the steering assembly 300 relative to the distance of the offset mechanism 309 from the focal point 307.

According to aspects of the present disclosure, a method for controlling the direction of a drilling assembly within a borehole is described herein, which may utilize steering assemblies similar to those described above with respect to FIGS. 2 and 3. FIG. 4 is a flowchart illustrating one example method. Step 401 may include positioning an offsetable drive shaft within the borehole. The offsetable drive shaft may be coupled to a drill bit and at least partially disposed within a housing. In certain embodiments, the offsetable drive shaft may be coupled to a tool collar, and the housing may be positioned proximate to an end of the tool collar. Step 402 may include rotating the offsetable drive shaft and drill bit in a first direction at a first speed. The offsetable drive shaft and drill bit may be rotated by a drill string. Step 403 may include rotating the housing in a second direction opposite the first direction at a second speed. In certain embodiments, the second speed may be the same as the first speed in order to maintain an angular orientation of the drill bit relative to a longitudinal axis of the housing. In certain embodiments, the housing may be rotated by a motor coupled to the housing. The motor may be disposed within the tool collar and include an output shaft that rotates the housing relative to the tool collar. The motor may comprise one of an electric motor and a hydraulic motor.

In certain embodiments, the method may further comprise altering the angular orientation of the drill bit by rotating the housing in the first direction at the first speed. Rather than rotating the housing in the second direction at the second speed, however, the housing may be rotated in the first direction at the first speed until the drill bit reaches a pre-determined angular orientation relative to the longitudinal axis of the steering assembly. The housing can also be rotated in a second direction or first direction at any speed other than the first speed in order to alter the angular orientation. Once the pre-determined angular orientation is reached, the housing can be rotated in the second direction at the second speed to maintain the drill bit in the pre-determined angular orientation.

In certain embodiments, a offset angle of the offsetable drive shaft may be fixed within the housing. This may be accomplished using an offset mechanism described above, or another mechanism that would be appreciated by one of ordinary skill in view of this disclosure. In certain other embodiments, the method may include altering a offset angle of the offsetable drive shaft within the housing. This may also be accomplished with a variable offset mechanism similar to the one described above.

As will be appreciated by one of ordinary skill in the art in view of this disclosure, the steering assembly and method described herein is able to provide a steerable drilling assembly with a diameter that is substantially the same as the diameter of the drill string. By avoiding any exterior extensions, such as actuators, etc., the steering assembly described herein may be able to pass through important downhole equipment, such as blowout preventers without damaging them. Therefore, the present disclosure is well adapted to attain the ends and advantages mentioned as well as those that are inherent therein. The particular embodiments disclosed above are illustrative only, as the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered or modified and all such variations are considered within the scope and spirit of the present disclosure. Also, the terms in the claims have their plain, ordinary meaning unless otherwise explicitly and clearly defined by the patentee. The indefinite articles "a" or "an," as used in the claims, are defined herein to mean one or more than one of the element that it introduces. Additionally, the terms "couple" or "coupled" or any common variation as used in the detailed description or claims are not intended to be limited to a direct coupling.

Rather two elements may be coupled indirectly and still be considered coupled within the scope of the detailed description and claims.

What is claimed is:

1. A system for controlling the direction of a drilling assembly within a borehole, comprising:

a tool collar;

a housing_positioned proximate to an end and at least partially outside of the tool collar;

an offsetable drive shaft coupled to the tool collar and a drill bit and at least partially disposed within the housing, wherein the tool collar and the offsetable drive shaft rotate in a same direction; and a motor coupled to the housing, wherein the motor, when activated, independently rotates the housing in a direction opposite from a direction of rotation of the offsetable drive shaft.

2. The system of claim 1, wherein the motor is disposed within one of the tool collar and the tool housing.

3. The system of claim 1, wherein the motor comprises one of an electric motor and a hydraulic motor.

4. The system of claim 1, wherein when the drill string is rotated in a first direction with a first speed, the tool collar and the offsetable drive shaft rotate in the first direction with the first speed.

5. The system of claim 4, wherein the motor, when activated, independently rotates the housing by at least rotating the housing in a second direction opposite the first direction with a second speed the same as the first speed.

6. The system of claim 1, wherein an offset angle of the offsetable drive shaft is maintained within the housing.

7. The system of claim 1, wherein an offset angle of the offsetable drive shaft is alterable within the housing.

8. A method for controlling the direction of a drilling assembly within a borehole, comprising:

positioning an offsetable drive shaft coupled to a tool collar within the borehole, wherein the offsetable drive shaft is coupled to a drill bit and at least partially disposed within a housing, and wherein the housing is positioned proximate to an end of the tool collar and at least partially outside of the tool collar;

rotating the offsetable drive shaft and drill bit in a first direction at a first speed;

rotating the housing in a second direction opposite the first direction at a second speed.

9. The method of claim 8, wherein the second speed is the same as the first speed, and wherein the rotating housing maintains an angular orientation of the drill bit with respect to a longitudinal axis of the drilling assembly.

10. The method of claim 8, wherein:

the offsetable drive shaft and drill bit are rotated by a drill string; and the housing is rotated by a motor coupled to the housing.

11. The method of claim 10, wherein the motor is disposed within one of the tool collar and the tool housing.

12. The method of claim 10, wherein the motor comprises one of an electric motor and a hydraulic motor.

13. The method of claim 8, further comprising altering the angular orientation of the drill bit with respect to the drilling assembly by rotating the housing in the first direction or the second direction at a speed other than the first speed.

14. The method of claim 8, wherein an offset angle of the offsetable drive shaft is fixed within the housing.

15. The method of claim 8, further comprising altering an offset angle of the offsetable drive shaft within the housing.

16. A system for controlling the direction of a drilling assembly within a borehole, comprising:

a tool collar coupled to a drill string;

a rotationally independent housing positioned proximate to an end and at least partially outside of the tool collar;

an offsetable drive shaft coupled to the tool collar and at least partially disposed within the housing, wherein the offset, wherein the drill string rotates the offsetable drive shaft;

an offset mechanism partially disposed around the offsetable drive shaft within the housing, wherein the offset mechanism controls an offset angle of the offsetable drive shaft; and a motor disposed within the tool collar, wherein the motor, when activated, rotates the rotationally independent housing in a direction opposite to a direction of rotation of the offsetable drive shaft.

17. The system of claim 16, wherein the motor comprises one of an electric motor and a hydraulic motor.

18. The system of claim 16, wherein the tool collar is coupled to the drill string such that when the drill string is rotated in a first direction with a first speed, the tool collar and the offsetable drive shaft rotate in the first direction with the first speed.

19. The system of claim 18, wherein the motor, when activated, at least rotates the rotationally independent housing in a second direction opposite the first direction with a second speed that is the same as the first speed.

* * * * *